United States Patent [19]

Cederquist et al.

[11] 4,136,831

[45] Jan. 30, 1979

[54] METHOD AND APPARATUS FOR MINIMIZING STEAM CONSUMPTION IN THE PRODUCTION OF PULP FOR FIBERBOARD AND THE LIKE

[75] Inventors: Karl Cederquist, Stockholm, Sweden; Bernard Marechal, Biarritz, France; Stig Selander, Stockholm, Sweden

[73] Assignee: Isel S.A., Paris-la-Defense, France

[21] Appl. No.: 821,711

[22] Filed: Aug. 4, 1977

[30] Foreign Application Priority Data

Aug. 6, 1976 [SE] Sweden ..... 7608847

[51] Int. Cl.[2] ..... B02C 23/40

[52] U.S. Cl. ..... 241/18; 241/28; 241/244

[58] Field of Search ..... 241/17, 18, 23, 28, 241/244

[56] References Cited

U.S. PATENT DOCUMENTS

| | | | |
|---|---|---|---|
| 3,661,328 | 5/1972 | Leask | 241/18 |
| 3,910,505 | 10/1975 | Reinhall | 241/18 |
| 3,921,918 | 11/1975 | Peterson | 241/28 |
| 4,012,279 | 3/1977 | Selander et al. | 241/28 |

*Primary Examiner*—Granville Y. Custer, Jr.
*Attorney, Agent, or Firm*—Eric Y. Munson

[57] ABSTRACT

Method and apparatus for minimizing steam consumption in the production of pulp used for the manufacture of fiberboard and the like, in which chips of cellulosic material are ground in a defibrator or refiner in an environment of saturated steam above 100° C and corresponding steam pressures. The chips are normally presteamed with atmospheric steam separated from the pulp at the discharge end of the defibrating process to a temperature between 90° C and 100° C and compressed and dewatered to a dryness of at least 50% and then passed into a preheater which forms part of the defibrating or refining apparatus, where the compressed and dewatered chips are heated to the desired defibrating or refining temperature, usually ranging between 130° C and 200° C, by a portion of the high-temperature high-pressure steam generated by the heat of friction in the grinding space of the defibrator, which portion, upon discharge from the grinding housing, is separated from the pulp and recirculated under increased pressure above the discharge pressure. If the other portion of the discharged atmospheric steam, upon separation from the pulp, should not have sufficient heat content to presteam the raw chips to the desired temperature, fresh pressurized steam may be added to the recirculated portion of the steam to impart to the other portion of the discharged steam the required capacity.

8 Claims, 1 Drawing Figure

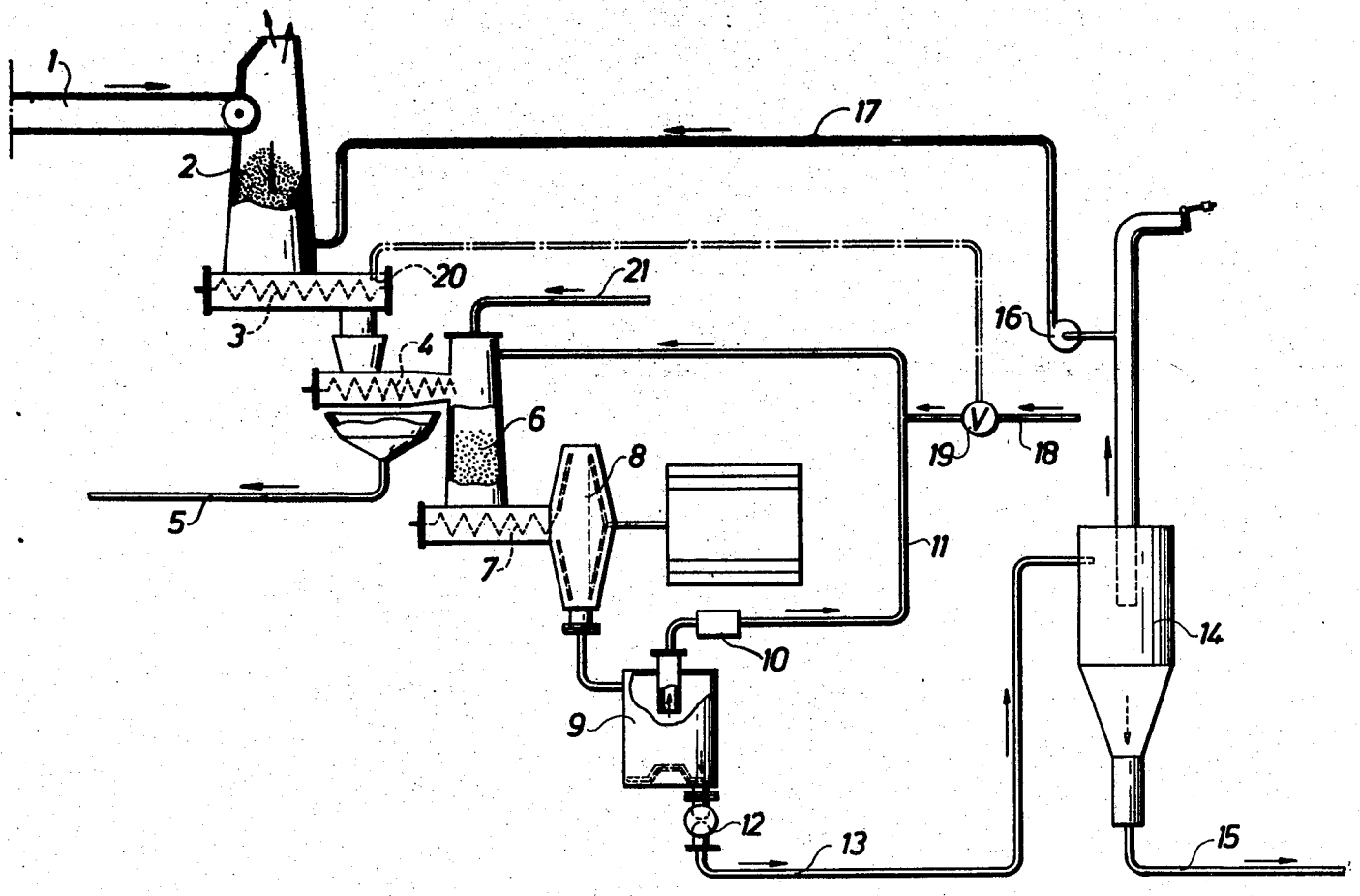
1
2
3
4
5
6
7
8
9
10
11
12
13
14
15
16
17
18
19
20
21

METHOD AND APPARATUS FOR MINIMIZING STEAM CONSUMPTION IN THE PRODUCTION OF PULP FOR FIBERBOARD AND THE LIKE

FIELD OF THE INVENTION

The present invention relates to a method and apparatus for producing pulp for fiberboard and the like, in which steam discharged at the end of the defibrating or refining process is used to presteam the raw pulp material.

BACKGROUND OF THE INVENTION

The lignocellulose material in the process of the present invention is mechanically defibrated to fiberpulp and may consist of wood, straw or bagasse, and will be generally referred to as wood or, disintegrated in form of pieces, as chips or raw chips.

The method of the present invention is applicable to all defibering processes in which the defibration of chips takes place in an atmosphere of saturated steam at temperatures exceeding 100° C., usually between 130° C. and 200° C. and corresponding steam pressures of 294 kiloPascals–1569 kiloPascals. The method provides a considerable saving of steam relative to that at present consumed in order to carry through the following conventional cycle, namely, presteaming of incoming raw chips to 90° C.–100° C. with steam at atmospheric pressure, defibration of the presteamed chips after heating with steam to the defibration temperature, blowing out fiberpulp and steam to a cyclone under atmospheric pressure and use of the separated 100° C. steam for presteaming of the raw chips. The pulp constitutes the basic material for the manufacture of fiberboard and is diluted and if necessary refined before forming into wet laps, which are pressed and/or dried to finished product. In particular, the present method is suitable when so-called disc refiners are used and provides a nearly 100% utilization of the heat developed by the defibration for increasing the temperature of the chips before entering the defibration zone.

Heretofore, the chips have been heated with fresh steam to the defibration temperature in a preheater directly connected to the defibrator, at which the heat generated in the defibration zone has only to a small extent been utilized for increasing the temperature of the chips entering the defibration zone.

As energy consumed for the defibration of the chips to a considerable extent, probably more than 80%, is transformed into heat, this means that at an energy consumption of 150 kwh per ton of pulp (dry) from wood chips with a dryness of 50% and the incoming chips preheated to 95° C., developed heat is sufficient to increase the temperature of the chips to 170° C. (defibration temperature) and, theoretically, no extra steam has to be added for increasing the temperature of the incoming chips to the defibration temperature. For carrying through the whole process, only such an amount of low pressure steam will be consumed as is required for increasing the temperature of the raw chips to 95° C.

It is known, as, for example, from U.S. Pat. No. 4,012,279, to preheat the incoming raw chips to the defibration unit with steam, which is released at the discharge of the pulp at atmospheric pressure. In the defibration process carried out up to this point, however, liberated steam contains considerably more heat than that consumed for the preheating of the raw chips to 90° C.–100° C., and this represents the main source of heat energy loss in the process.

In order to attain the lowest possible heat consumption in the defibration process, the released steam should not contain more heat than is consumed for preheating the incoming raw chips to 90°–100° C. This implies, generally, that all heat generated in the defibration zone has to be used for heating the chips before reaching the defibration zone. The generated heat, however, is usually not sufficient to bring the chips to the defibration temperature and, therefore, addition of fresh steam is required.

SUMMARY OF THE INVENTION

The present invention contemplates a method and apparatus for minimizing steam consumption in the production of pulp for fiberboard and the like from lignocellulosic material by using refiners or defibrators operating at a temperature above 100° C., preferably at temperatures ranging between 130° C. and 200° C., and corresponding steam pressures ranging between 3 $kgs/cm_2$ and 16 $kgs/cm_2$ or 294–1569 kiloPascals. The object of the invention is achieved by separating a portion of the steam discharged at the outlet side of the defibrator and recirculating it to the inlet side under increased pressure above the discharge pressure to impart to the separated portion of the steam a heating capacity to heat the chips to the desired defibrating temperatures at the inlet side.

By recirculation of steam from the discharge side of the defibrator to the feed-in side, with a low pressure compressor or some other type of blowing machine, heat is forced back to the feed-in side for heating the chips before reaching the defibration zone. The additional heat in form of fresh steam, which must be imparted to the chips in order to raise the temperature in the defibration zone, can be supplied either before or after the low pressure compressor. The compressor operates with a slightly increased pressure above the pressure prevailing at the discharge side of the defibrator, so that the circulating steam can overcome the resistance which arises during the passage of the steam through the chips and the defibration zone, and thus allows the steam to accompany the chips and pulp through the defibrator. In this manner, the steam which is generated in the defibration zone is also prevented from blowing backwards against the incoming chips, which, among other things, can disturb an even supply of chips.

Also, in the present case, when operating with a closed white water system, for example, white water can be added to the defibrator as described in U.S. Pat. No. 4,012,279.

BRIEF DESCRIPTION OF THE DRAWING

The drawing is a flow sheet illustrating schematically how the process according to an embodiment of the invention may be carried out in order to minimize the comsumption of energy.

DETAILED DESCRIPTION OF AN EMBODIMENT OF THE INVENTION

Referring to the drawing, the incoming chips are continuously fed by the conveyor 1 to the chip presteamer 2 where the chips meet in counterflow discharged steam of 100° C., which imparts to the chips a temperature of 90° C.–100° C. when they pass through the feeder 3. From the feeder 3, the hot chips are passed to the screw conveyor 4, which feeds the chips into the defibrator preheater 6 and simultaneously dewaters the chips by squeezing out water so that they acquire dryness of at least 50%, suitably 55%–65%. The squeezed-out warm water is discharged through the pipe 5. Steam is passed to the preheater 6 partly through recirculation of process steam from the pressure vessel 9 via the steam compressor 10 and the pipe 11, and partly by addition of fresh steam through the pipe 18, so that the temperature of the incoming chips to the defibrator 8 via the feeder 7 will correspond to the defibration temperature. The pressure vessel 9 should preferably be cylindrical and designed so that the pulp is introduced tangentially and the steam drawn off from the center of the vessel as in a cyclone. If necessary, a filter can be fitted in the circulation pipe before the compressor 10 in order to free the steam from accompanying fibers. The amount of fresh steam is regulated so that the chips after having passed through the presteamer 2 will have a temperature between 90° C. and 100° C., and this is achieved by means of a temperature indicator 20 located in the feeder 3 which governs the valve 19 for supplying fresh pressurized steam to the pipe 11. By forced circulation, the generated steam in the defibration zone will be conveyed along with the pulp to the pressure vessel 9. Pulp and excess steam are blown out through the discharge valve 12 and the pipe 13 to the cyclone 14, where steam and pulp are separated. The pulp may be diluted with so-called white water and is discharged through the pipe 15 for the manufacture of board sheets, and the steam is blown by the fan 16 through the pipe 17 to the chip preheater 2. White water can suitably be supplied to the defibrator through the pipe 21.

Sufficient fresh pressurized steam should be supplied to the defibrator preheater so that the amount of released steam at the discharge of the pulp has a heat content sufficient to increase the temperature of the raw chips to 90° C.–100° C. This creates an excess of steam in the defibrator system, and such excess must be blown off. The formation of excess steam in the defibrator unit also enhances the discharge of the pulp from the pressure vessel.

In order to explain the advantages resulting from recirculation of steam, a specific example is given below for a pulp production of 5000 kg/h dry fiber pulp from wood under following conditions: yield by weight 99%, dryness of the raw chips 50% and entrance temperature +5° C., power consumption 625 Kwh and defibration temperature 171° C. corresponding to 785 kiloPascals ($8kg/cm_2$) steam pressure.

Preheating of incoming raw chips from 5° C. to 95° C. consumes 1233 kg steam of atmospheric pressure and produces a corresponding amount of condensate. The chips will then attain a dryness of 44.5% and 2153 kg water is squeezed out when the chips are fed by the screw feeder 3 into the defibrator preheater 6. The entering chips have then a dryness of 55% and a temperature of 95° C. In order to increase the temperature in the defibrator preheater to 171° C., 492,000 Calories are consumed, which corresponds to 1004 kg steam of 785 kiloPascals absolute pressure. 80% of added defibration energy is converted into heat, which corresponds to 430,000 Calories or 877 kg steam from water of 171° C. Therefore, 127 kg steam must be added in order to provide a sufficient amount of heat available for increasing the temperature of the chips to the defibration temperature. This is the theoretically lowest possible steam consumption with which the defibration can be carried out when the temperature of entering chips to the defibrator preheater is 95° C.

At the discharge of the finished pulp under these conditions, only 823 kgs steam of atmospheric pressure are released, and, consequently, 410 kg must be added in order to make it possible to preheat the raw chips to 95° C. It is, however, more advantageous to supply the heat which is lacking for the preheating of the raw chips in the form of high pressure steam to the defibrator preheater, as thereby the discharge of the pulp is enhanced. Therefore, a total amount of 522 kgs of fresh steam of 785 kiloPascals has to be supplied to the defibrator preheater, which, together with the heat generated in the defibration zone, produces 1399 kgs of steam at a pressure of 785 kiloPascals. Of this amount of steam, 1004 kgs are recirculated, and the balance of 395 kgs is discharged with the pulp, which, when reduced to atmospheric pressure, produces so much steam that incoming raw chips can be preheated to 95° C.

Under the aforementioned conditions, 125 Kwh and 105 kgs of steam at a pressure of 785 kiloPascals per ton of produced pulp are consumed. As far as we know, this implies an energy consumption considerably lower than that which, up to date, is used by the defibration of wood.

At the operation of the defibration process with the lowest possible total energy consumption, the amount of released steam is in normal cases fully sufficient for the transportion of the discharged pulp to the cyclone separator. In some cases, depending on the length of the blow pipe, level differences or production capacity, the released steam may, however, be insufficient. In such cases, an extra amount of steam must be added to the defibration system, which is most easily achieved by increasing the supply of fresh steam to the defibrator. In some cases, it is also possible to add steam to the blow pipe after the discharge valve and in this way increase both the amount and pressure drop of the transporting steam.

We claim:

1. In the method of producing pulp for fiberboard and the like, in which raw chips of lignocellulosic material are defibrated in a defibrator in an atmosphere of saturated steam at predetermined defibrating temperatures above 100° C. and corresponding steam pressures, the chips prior to being passed to the inlet side of the defibrator having been presteamed to a predetermined temperature by atmospheric steam released from the mixture of steam and pulp at the outlet side of the defibrator, compressed and dewatered to a dryness of at least 50%, the improvement for minimizing steam consumption, comprising:

(a) separating a portion of the high-pressure high-temperature steam from the mixture of steam and pulp discharged at the outlet end of the defibrator;

(b) increasing the pressure of said separated portion to impart thereto sufficient heat content to heat the presteamed chips at the inlet side of the defibrator to the predetermined defibrating temperature; and (c) recirculating said pressurized separated portion to the inlet side of the defibrator.

2. A method according to claim 1, in which fresh pressurized steam is passed into the recirculated steam in an amount sufficient to impart to the mixture of steam and pulp separated from the recirculated steam, power to provide for its transportation to a cyclone for separation of steam from the pulp.

3. A method according to claim 1, in which fresh pressurized steam is passed to the circulating steam in an amount such that the heat content of the atmospheric steam released from the mixture of steam and pulp discharged from the defibrator is sufficient to preheat the raw chips to a temperature between 90° C. and 100° C.

4. A method according to claim 3, in which the amount of fresh pressurized steam passed into the circulating steam is controlled by a temperature indicator, which keeps the temperature of the raw chips preheated with released atmospheric steam constant.

5. In an apparatus for producing pulp for fiberboard and the like from lignocellulosic material, in which raw chips are defibrated in a defibrator in an atmosphere of steam at predetermined defibrating temperatures above 100° C. and corresponding steam pressures, the chips prior to being passed to the inlet side of the deribrator having been presteamed to a predetermined temperature by atmospheric steam released from the mixture of pulp and steam at the outlet side of the defibrator, compressed and dewatered to a dryness of at least 50%, the improvement comprising:

(a) means for separating a portion of the high-pressure high-temperature steam from the mixture of pulp and steam discharged at the outlet side of the defibrator;

(b) means for increasing the pressure of said separated steam to impart thereto a heat content sufficient to heat the presteamed chips at the inlet side of the defibrator; and (c) conduit means for recirculating said pressurized separated steam to the inlet side of the defibrator to the predetermined defibrating temperature.

6. An apparatus as claimed in claim 5, in which the inlet side of the defibrator comprises a preheater for receiving the presteamed chips, and the outlet side comprises a pressure vessel for receiving said portion of high-pressure high-temperature steam, said pressure vessel being connected to said conduit means for recirculating said portion of steam to the preheater.

7. An apparatus as claimed in claim 6, further comprising a compressor interposed in said conduit means.

8. An apparatus as claimed in claim 5, including a connection for supply of fresh pressurized steam to said conduit means.

* * * * *